US005715564A

United States Patent [19]

Knouse

[11] Patent Number: 5,715,564

[45] Date of Patent: Feb. 10, 1998

[54] DUSTPAN

[76] Inventor: Craig L. Knouse, 2115 NE. 49th St., Vancouver, Wash. 98663

[21] Appl. No.: 702,909

[22] Filed: Aug. 26, 1996

[51] Int. Cl.[6] ..... A47L 13/52

[52] U.S. Cl. ..... 15/257.3; 15/257.1; 15/257.8

[58] Field of Search ..... 15/257.1, 257.2, 15/257.3, 257.4, 257.5, 257.6, 257.7, 257.8, 257.9; 248/210, 211; 294/1.3

[56] References Cited

U.S. PATENT DOCUMENTS

| | | | |
|---|---|---|---|
| 132,176 | 10/1872 | Potwin | 15/257.2 |
| 221,312 | 11/1879 | Howe | 15/257.9 |
| 509,689 | 11/1893 | Sarchet | 15/257.6 |
| 760,391 | 5/1904 | Fuller . | |
| 849,239 | 4/1907 | Hill | 15/257.2 |
| 931,867 | 8/1909 | Hawkinson | 15/257.4 |
| 1,053,438 | 2/1913 | Resch | 15/257.3 |
| 1,255,902 | 2/1918 | Marriott | 15/257.3 |
| 2,763,143 | 4/1956 | Timmons . | |
| 2,812,784 | 11/1957 | Palmer . | |
| 3,018,502 | 1/1962 | Lossius | 15/257.2 |
| 3,156,941 | 11/1964 | Tomaiuolo | 15/257.1 |

FOREIGN PATENT DOCUMENTS

| | | | |
|---|---|---|---|
| 854938 | 4/1940 | France | 15/257.4 |

*Primary Examiner*—Randall Chin
*Attorney, Agent, or Firm*—James D. Givnan, Jr.

[57] ABSTRACT

A dustpan having an inclined bottom wall with rearwardly convergent sidewalls coterminous with the bottom wall. A handle assembly is attached to the sidewalls at points therealong to facilitate lifting of the dustpan in a balanced horizontal manner. The convergent sidewalls, in addition to confining debris within the dustpan, limit inward movement of a broom head. A support on the bottom wall is of hook configuration to enable hanging of the dustpan on the edge of a waste receptacle.

4 Claims, 1 Drawing Sheet

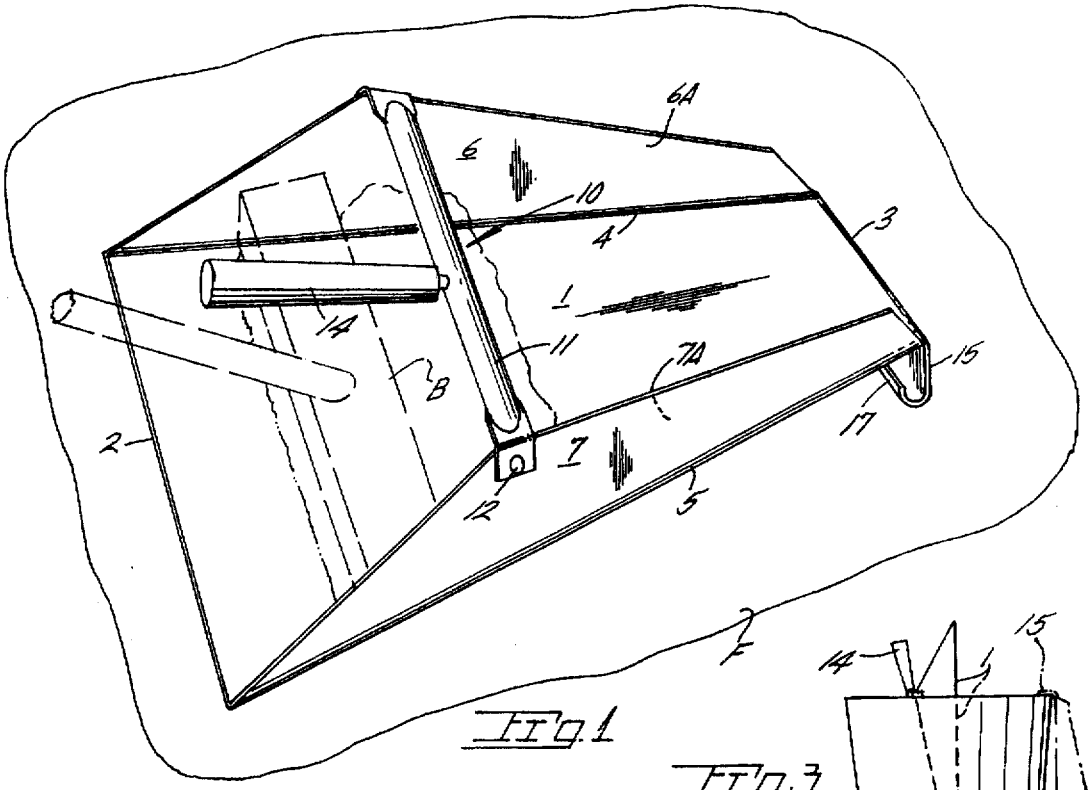
FIG. 1
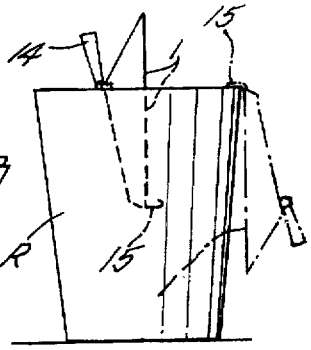
FIG. 3
FIG. 2
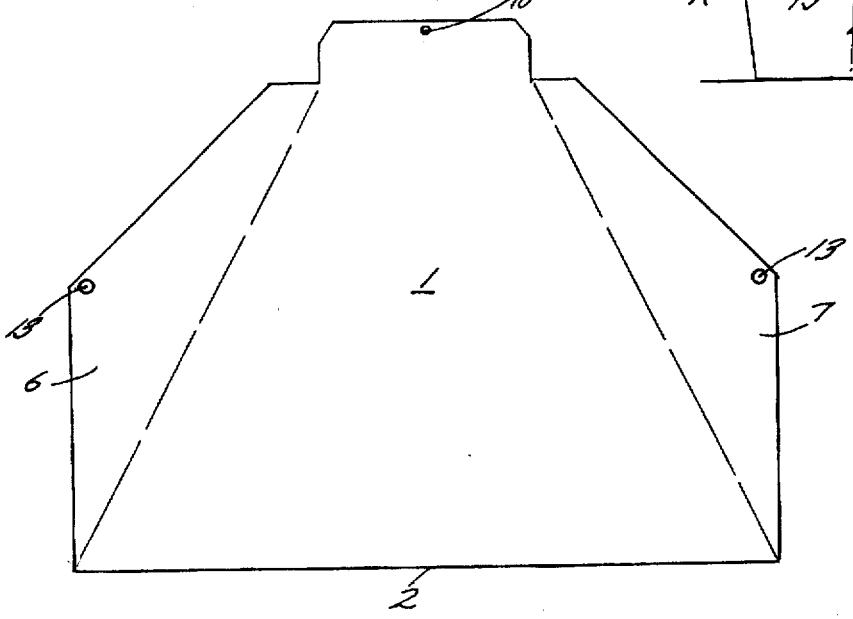

DUSTPAN

BACKGROUND OF THE INVENTION

The present invention pertains generally to dustpans and particularly that type of dustpan particularly suited for use in commercial establishments.

In work locations where a large quantity of waste collects on a floor, as for example, in a machine shop, floors must be swept frequently during the work day with each sweeping resulting in a sizeable amount of debris. Existing dustpan configurations are not suitable for collection of large amounts of debris. Additionally problems are encountered in industrial locations wherein sweepings from a floor can be of considerable weight. Accordingly, typical dustpans with a handle projecting from one end of the pan are highly impractical.

In the prior art, U.S. Pat. No. 760,391 shows a dustpan with convergent sidewalls as does U. S. Pat. No. 1,053,438. The latter patent also discloses a handle and bail combination attached to dustpan sidewalls. U.S. Pat. No. 2,812,784 shows a dustpan with rolled sides which tend to converge and which may serve as handles, while U.S. Pat. No. 2,763,143 shows a dustpan with converging sidewalls and a support for elevating the dustpan bottom wall.

SUMMARY OF THE PRESENT INVENTION

The present invention is embodied within a dustpan intended for use where large amounts of debris must be collected and disposed of during a work day.

The present dustpan includes a sloped bottom wall having rearwardly convergent sidewalls and a support at the rearward end of the bottom wall which may also serve as a hanger for the dustpan.

The present dustpan may be molded or formed from sheet stock in a cutting and forming operation to contribute to a low cost of manufacture. A handle assembly is located intermediate the fore and aft ends of the bottom wall to facilitate lifting of the dustpan without tipping. The convergent sidewalls limit travel of a brush head or block into the dustpan to discharge the debris approximately at the dustpan center of gravity. A dustpan support component includes a hooked segment to facilitate storage of the dustpan on a supporting surface, as for example, on the edge of a debris container or barrel.

BRIEF DESCRIPTION OF THE DRAWINGS

In the drawings:

FIG. 1 is a perspective view of the present dust pan;

FIG. 2 is a plan view of a piece of sheet stock cut during construction of the dustpan and prior to forming of same; and FIG. 3 is an elevational view of a waste receptacle with the present dustpan supported by the rim of the receptacle.

With continuing attention to the drawings, wherein applied reference numerals indicate parts similarly hereinafter identified, the reference numeral 1 indicates the bottom wall of the present dustpan.

The bottom wall terminates forwardly in a front edge 2 and rearwardly at a curved edge 3. Bottom wall 1 is inclined relative a floor F by reason of a later described support. Integral with bottom wall 1, along corners at 4 and 5, are dustpan sidewalls 6 and 7. The walls are generally perpendicular to bottom wall 1 and are convergent from dustpan front edge 2 toward dustpan rear edge 3. The dustpan is open at the front edge 2 and rear edge 3. Interior wall surfaces 6A and 7A serve to confine debris within the dustpan and additionally serve to limit entry of a broom head or block B into the dustpan.

A handle assembly generally at 10 includes a bail 11 secured at its ends by fasteners as at 12 to the dustpan sidewalls. A suitable bail is of tubular material with flattened end segments and thereat apertured for insertion of fastener elements 12 which are received in apertures 13 in each sidewall. A handle at 14 is suitably attached to bail 11 and projects forwardly therefrom.

Integral with rearward edge 3 of bottom wall i is a dustpan support 15. The support includes a hooked lower edge 17 which facilitates the support 15 additionally serving as a hanger for convenient storage of the dustpan such as on the edge of a waste receptacle. Additionally, hooked edge 17 of the support may be apertured at 18 at its center to facilitate support of a stored dustpan on a hook.

With attention again to the handle assembly 10, bail 11 is medially disposed relative front and rear edges 2 and 3 of bottom wall 1 to contribute to lifting of the loaded dustpan in a generally horizontal or balanced manner. Also contributing to such lifting are convergent sidewalls 6 and 7 which limit inward movement of broom head or block B during dustpan use. By way of example, broom heads commonly used in commercial establishments, have a length of 18 or 24 inches. Such broom heads are limited in their entry into the dustpan by sidewall surfaces 6A and 7A having corresponding pairs of brush contact points located therealong denoting transverse spans of 18 inches and 24 inches (as well as other spans). In one preferred embodiment of the present dustpan, the forward edge 2 is 30 inches in length while rearward edge 3 is 9 inches in length, with the two edges spaced from one another approximately 20 inches. The front edge is desirably of a length greater than the length of the rear edge by a factor of two. Accordingly, the sidewalls will define an included angle of approximately 55° to locate the corresponding points along sidewall surfaces 6A and 7A.

With attention to FIG. 3, dustpan contents may be dumped into a receptacle such as a thirty or fifty five gallon drum R by simply placing the dustpan on the rim of same in an overbalanced condition and releasing the handle with the dustpan automatically coming to rest as shown with dustpan contents being discharged past rear edge 3.

As shown in FIG. 3, the dustpan is stored conveniently on the rim of waste receptacle R by means of hooked edge 17 of support 15.

While I have shown but one embodiment of the invention, it will be apparent to those skilled in the art that the invention may be embodied still otherwise without departing from the spirit and scope of the invention.

Having thus described the invention, what is desired to be secured by a Letters Patent is:

1. A dustpan attachable to a trash receptacle when not in use and comprising, a bottom wall having a front edge and a rear edge, said rear edge of lesser length than said front edge, rearwardly convergent sidewalls integral with said bottom wall, said dustpan being open at the front and rear edges, said sidewalls serving to confine trash for discharging trash past said rear edge, a handle assembly affixed to said sidewalls and including a handle spaced above and inclined relative to said bottom wall, a support depending from said rear edge of said bottom wall and positioning said rear edge at an elevation above said front edge when the dustpan is in use on a floor surface, said support having a distal end of hook configuration enabling suspension of the dustpan from the rim of the receptacle.

2. The dustpan claimed in claim 1 wherein said convergent sidewalls have brush contact points to limit entry of a broom brush block into the dustpan, one of said pair of brush contact points spaced apart a distance of approximately eighteen inches, another pair of contact points spaced apart approximately twenty four inches.

3. The dustpan claimed in claim 1 wherein said front edge is of a length greater than the length of said rear edge by a factor of two.

4. The dustpan claimed in claim 3 wherein said front edge and said rear edge are approximately thirty and nine inches in length respectively.

* * * * *